United States Patent [19]

Baur

[11] 4,325,753

[45] Apr. 20, 1982

[54] PROCESS FOR DEGREASE ANNEALING THIN STRIP AND FOIL MADE OF ALUMINUM AND ALUMINUM ALLOYS

[75] Inventor: Rudolf Baur, Kreuzlingen, Switzerland

[73] Assignee: Swiss Aluminium Ltd., Chippis, Switzerland

[21] Appl. No.: 189,174

[22] Filed: Sep. 22, 1980

[30] Foreign Application Priority Data

Oct. 18, 1979 [CH] Switzerland ..... 9355/79

[51] Int. Cl.[3] ..... C22F 1/02

[52] U.S. Cl. ..... 148/20.3; 148/20.6

[58] Field of Search ..... 148/13, 13.1, 20.3, 148/20.6

[56] References Cited

U.S. PATENT DOCUMENTS 3,061,485 10/1962 Robinson ..... 148/13.1

*Primary Examiner*—R. Dean

*Attorney, Agent, or Firm*—Bachman and LaPointe

[57] ABSTRACT

On degrease annealing of thin strip and foil made of aluminum and aluminum alloys in an annealing furnace ozone is introduced into the furnace atmosphere.

As a result of this the annealing time can be shortened or the annealing temperature lowered. Likewise the tendency for the foil to stick together when in coiled form is markedly reduced.

5 Claims, No Drawings

PROCESS FOR DEGREASE ANNEALING THIN STRIP AND FOIL MADE OF ALUMINUM AND ALUMINUM ALLOYS

BACKGROUND OF THE INVENTION

The invention relates to a process for degrease annealing in a furnace thin strip and foil made of aluminum and aluminum alloys.

In the roll forming of aluminum strip down to thin strip and foil—hereinafter denoted simply by the term foil-petrol-based lubricating oil or agueous lubricating oil emulsions are employed as aids to rolling, whereby today mainly paraffin based petrols containing additives such as palm seed oil, long chain alkyl alcohols, monocarboxylic acid alkyl-esters etc. are used. The foils which are coiled into rolls are then placed in large batch ovens or furnaces and annealed, i.e. heated at elevated temperatures, in dry air. This annealing operation produces a degreasing effect i.e. the surface of the foil is freed of the rolling lubricant lying on its surfaces. Another result of the annealing is that the foil is transformed from the hard rolled condition into a soft condition which is necessary for certain subsequent operations.

After a degrease anneal at temperatures higher than 250° C.—both here and in the following specification the annealing temperature is to be understood as the metal temperature—it is found that the individual layers in the coil stick together to a greater or lesser degree. The sticking increases strongly with increasing annealing temperature. In addition, at temperatures above about 400° C. the surface of the foil can become discolored. Rolls of foil which exhibit such sticking tendencies can be handled in further operations only with considerable difficulty.

Commercial degrease annealing treatments are, today, conducted in such a way that the rolls of foil are annealed in furnaces at a metal temperature of 250°-300° C., with annealing times of approximately 30 to 60 hours depending on the size of coil, being required to achieve complete removal of rolling lubricant residues. The occasional rejection of foil due to sticking has to be accepted with this practice. The relatively long annealing times lead periodically to a shortage of free capacity for annealing and, in addition, represent a more than negligible cost factor.

SUMMARY OF THE INVENTION

It is therefore an object of the invention to influence the degrease annealing process in such a way that the annealing times can be shortened and the sticking tendency of foils rolled into coils is reduced.

This object is achieved by way of the invention in that ozone is introduced into the atmosphere of the annealing furnace.

Due to the presence of ozone in the annealing furnace atmosphere the oxidizing reaction producing the removal of rolling lubricant components is greatly accelerated. Compared with an ozone-free atmosphere a complete degreasing of the foil surface is achieved in an approximately 30% shorter annealing time.

It is almost no longer possible to observe a sticking tendency even at annealing temperatures around 400° C., which is something that cannot simply be taken for granted as a result of accelerating the degreasing process. This reduced sticking tendency is possibly related to a structural change in the oxide on the foil formed by the activated oxygen during the anneal.

In atmospheres containing ozone a foil surface which is completely free of residuals from the rolling lubricant can be achieved at annealing temperatures as low as 150° C. Use can be made of this when one does not wish to convert the hard rolled foil to a completely soft condition during the degrease anneal.

The following example shows the advantage of degrease annealing in an ozone-containing atmosphere.

EXAMPLE

Rolls of 5 μm thick foil of pure aluminum were degreased by annealing under various conditions in a laboratory furnace. A paraffin based petrol containing palm seed oil as additive was used for the cold rolling of the foil. The 35 mm wide foils were coiled onto spools which are 40 mm in diameter. The outer diameter of the rolls of foil was then 60 mm.

The furnace atmospheres used were dried synthetic air with and without the addition of ozone. In the trials using ozone 0.2 vol. % ozone was added to the flushing gas which was passed through the furnace at 185 $cm^3$/min.

The wettability of the foil surface was used to measure the degree of degreasing, whereby the diameter of a 5 μl droplet of water was taken as the absolute measure.

To determine the sticking tendency, the rolls of foil were suspended on almost frictionless bearings. By hanging weights on the free end of the foil it was possible to determine the critical load at which the foil started to unroll itself. The force calculated over a foil breadth of 1 mm was taken as the force of adhesion.

The essential results from the trials are summarized in the following table. From this table it can be clearly seen that by adding ozone to the furnace atmosphere the sticking tendency is reduced over the whole range of temperatures investigated. Much shorter annealing times are required for practically complete degreasing of the foil surface.

| Annealing Conditions | | Addition | Droplet Test | Sticking Force | Tensile Strength |
|---|---|---|---|---|---|
| °C. | h | of Ozone | mm/μl | g/mm | $N/mm^2$ |
| 400 | 2 | – | 10 | 0.35 | 78 |
| | 2 | + | 10 | 0.09 | 81 |
| 300 | 6 | – | 10 | 0.15 | 84 |
| | 2 | – | 8 | 0.41 | 80 |
| | 2 | + | 9.5 | 0.06 | 82 |
| 215 | 40 | – | 9.5 | 0.10 | 79 |
| | 6 | – | 6.5 | 0.85 | 86 |
| | 2 | – | 4 | 0.70 | 82 |
| | 2 | + | 8.5 | 0.06 | 87 |
| 150 | 2 | + | 9.5 | 0.06 | 100 |

What is claimed is:

1. Process for degrease annealing of thin strip or foil made of aluminum or aluminum alloys in an annealing furnace which comprises:

providing said aluminum strip or foil containing lubricating oil residue thereon, and degrease annealing said aluminum strip or foil in an annealing furnace containing ozone at an elevated temperature, thereby obtaining reduced sticking tendency and accelerated removal of lubricating oil residue with ability to achieve degreasing in approximately 30% shorter time than in ozone-free atmosphere.

2. Process according to claim 1 wherein the metal temperature is in excess of 150° C.

3. Process according to claim 1 wherein the metal temperature is from about 150° to about 400° C.

4. Process according to claim 1 wherein said aluminum strip or foil is annealed in coiled form.

5. Process according to claim 1 wherein approximately 0.2 volume percent ozone is employed.

* * * * *